United States Patent [19]

Murphy

[11] 4,344,617

[45] Aug. 17, 1982

[54] CROSSARM INCLUDING CABLE REWINDING MEANS FOR SUPPORTED GYMNASTIC EQUIPMENT

[76] Inventor: Raymond J. Murphy, Bonne Terre, Mo. 63628

[21] Appl. No.: 157,503

[22] Filed: Jun. 9, 1980

Related U.S. Application Data

[60] Continuation-in-part of Ser. No. 135,194, Mar. 28, 1980, which is a division of Ser. No. 842,532, Oct. 17, 1977, Pat. No. 4,204,719.

[51] Int. Cl.³ ..... A63B 7/00

[52] U.S. Cl. ..... 272/109

[58] Field of Search ..... 272/1 R, 24, 40–42, 272/61–64, 70, 71, 90–92, 109, 131–136; 434/29, 30, 34; 104/1 R, 62, 87, 117; 294/85

[56] References Cited

U.S. PATENT DOCUMENTS

| | | | |
|---|---|---|---|
| 558,413 | 4/1896 | Nilsson | 272/24 |
| 895,055 | 8/1908 | Spooner | 272/70 |
| 1,859,615 | 5/1932 | Brierley | 272/24 |
| 2,197,600 | 4/1940 | Wimer | 272/61 |
| 3,432,163 | 3/1969 | Murphy | 272/24 X |
| 3,780,663 | 12/1973 | Pettit | 272/70 X |
| 4,026,548 | 5/1977 | Birdwell | 272/70 X |
| 4,114,874 | 9/1978 | Mattila | 272/71 |
| 4,135,714 | 1/1979 | Hughes | 272/136 |

FOREIGN PATENT DOCUMENTS

| | | | |
|---|---|---|---|
| 379387 | 8/1923 | Fed. Rep. of Germany | 272/24 |
| 904689 | 2/1954 | Fed. Rep. of Germany | 272/70 |
| 829380 | 3/1938 | France | 272/61 |
| 407125 | 3/1934 | United Kingdom | 272/24 |

OTHER PUBLICATIONS

"Buschman Bush-Lock Cable", E. W. Buschman Co., 1966, p. 2.

*Primary Examiner*—Richard J. Apley
*Attorney, Agent, or Firm*—Paul M. Denk

[57] ABSTRACT

An improved crossarm for use for holding gymnastic or other equipment, including a support for the invalid, the crossarm includes a series of cables that are suspended downwardly for holding a support for the gymnast or invalid, with the cables extending further upwardly for turning about sheaves associated with the approximate ends of the crossarm, and extending into for winding upon a cable holding device that is effective in retracting any cable in the event that slack occurs; the crossarm also is hingedly mounted, at its upper central portion, to provide for pivot of the crossarm in at least two directions to aid and be of convenience to the user.

2 Claims, 7 Drawing Figures

CROSSARM INCLUDING CABLE REWINDING MEANS FOR SUPPORTED GYMNASTIC EQUIPMENT

CROSS REFERENCE TO RELATED APPLICATION

The subject matter of this application is related to, and comprises a continuation-in-part application of the prior U.S. patent application of the same inventor, Ser. No. 135,194, filed Mar. 28, 1980, which is a division of U.S. Ser. No. 842,532, now U.S. Pat. No. 4,204,719, issued on May 27, 1980, and filed on Oct. 17, 1977.

BACKGROUND OF THE INVENTION

This invention relates to an automatic retractor spring means for use in conjunction with crossarm supporting gymnastic equipment, and which compensates for any slack developing within its supporting cables so as to maintain firm tensioning upon the gymnast during maneuvering.

In the identified prior patent applications, it was generally described that a crossarm is used in conjunction with a particular style of bearinged support, that support being of the type that encircles the approximate waist or hip of the gymnast, so as to authorize the performance of the variety of technical maneuvers made by such an athlete, during practice or performance, and to insure safety against injury due to the suspended support afforded by the invention of the parent application. As can be seen, and as set forth in the description of the prior invention, the crossarm has various cables associated with it, and which cables, at least at their upper ends, are supported by springs so as to furnish some resiliency in the length of the cable as adjusted for supporting the gymnast during performance. But, one minor problem associated with that type of structure, and the cable feature for supporting the bearinged support, is that when the gymnast, particularly when practicing upon a trampoline, elevates due to a jumping maneuver, the cable frequently slackens to the extent that it can become entangled with the gymnast's arms, or cause other disruption during his routine maneuvering. As a result of the foregoing type of minor problems, with the previously described supporting equipment, the current invention has for its primary objective the provision of rewind means that effectively retracts any loosened or slackened cable particularly when the gymnast elevates during performance of a gymnastic feat.

Another object of this invention is the combining of the resiliency of cable holding coil springs with the retracting feature of a spiral spring holding the opposite ends of the same cables for insuring both a buffering of the impact encountered by a gymnast when supported by a bearinged support when it reaches the lower limits of its descent, but at the same time effectively retracts any slackened cable particularly when any elevation is achieved by the same gymnast.

A further object of this invention is to provide means for constantly furnishing pull upon the cables used for holding the gymnastic support and thereby providing an instant lift for facilitating the designed movements undertaken particularly by the novice.

Still another object of this invention is to provide stop means for assuring the limits to cable rewinding or withdrawal during usage of this crossarm support by the gymnast.

Still another object of this invention is to provide a crossarm support for holding gymnastic equipment and which is hinged for providing it with limited swingability during usage.

These and other objects will become more apparent to those skilled in the art upon reviewing the summary of this invention, and upon undertaking a study of the description of the preferred embodiment in view of the drawings.

SUMMARY OF THE INVENTION

This invention contemplates a modification to the gymnastic equipment supporting crossarm and which compensate for prior deficiencies for perfecting gymnastic equipment usage during both performance in practice and in composition. More specifically, this invention envisions modifications to the style of crossarm previously analyzed in my prior patent applications for this type of invention, wherein the crossarm now has associated with it a pair of cables, with each cable, at one end, still entering into a tubular member that forms each lateral portion of the crossarm, with these cable ends extending through an arranged coil spring and being secured with its inwardmost end for achieving some resiliency in its pull as when the gymnast may reach the lower extent of his movement during a maneuver. On the other hand, the opposite end of each cable extends downwardly through a sheave associated with the side of the gymnast's bearing support, as previously analyzed in our prior applications, with said cables then extending upwardly for entering through another sheave operatively associated with the crossarm ends, for their extension centrally towards a cable holding means, which is spring loaded, preferrably by means of a spiral spring, and which functions as a cable retractor to eliminate any slack in the cable, particularly when the gymnast may reach or approach the vicinity of the upper limits of a maneuver, as when jumping upon a trampoline, or performing a summersault in place, as upon a parallel bar.

The slack cable retractor of this invention includes a cable holding means generally formed in the nature of a reel, and which is divided into two parts, for holding each of the cables, extending upwardly from the bearinged support, independently from each other, so that said cable ends will not become entangled when they are being retracted or rewound onto the same, as when the gymnast reaches the upper limits of his movement, as previously described, and at the same time, to allow for the unentangled feed-out of each cable when the gymnast maneuvers into a lowering position.

The crossarm, as previously described, comprises a tubular member, and a pair of flanges extend centrally downwardly from the member, and support a shaft between their lower ends. The cable holding means, or said reel, is arranged for rotation upon said shaft, and incorporates within its interior, and within the reel base that holds said cables, space for locating of said spiral spring, with said spring being affixed to the internals of the said reel, or to its base, at its outer end, while the internal end of the spiral or helical spring secures with the fixed shaft upon which the reel rotates. Hence, as can be understood, as cable is unwound, the spring becomes tighter in its positioning, thereby increasing its spring force for effecting rapid rotation of said reel in the opposite direction, as when the cable is to be retracted or rewound onto said reel.

The separate portions or divided parts of the reel, and onto which each separate cable end is tied, and rewinds, are arranged such so that one cable winds from the upper side of one part of the divided reel, while the other cable winds from the lower side of the other part of said divided reel. Hence, as can be understood, as the two cables unwind, they both unwind simultaneously, since cable from one side is being fed off from the upper side of the reel, while the cable from the other part unwinds from the other part of the underside of the divided reel. Furthermore, as the cables are being retracted, or rewound upon the divided reel, obviously the rotation of the said cable holding means is in the opposite direction and effects a rewinding of both cables upon their respectively divided portions of the said reel.

In order to prevent too much of the cable from being unwound from the cable holding means, stop means, in the nature of swingable copper ferrules, may be tightly clamped onto one of the cables, at a desired location, and then having a clamping mechanism secured thereon for preventing the rewinding of unwinding of said cables beyond the limits set by means of the location of said stop means.

The size and requirements for the spring means used in conjunction with the cable holding means of this invention very well depend upon the weight of the party utilizing this crossarm. But generally, the spring will be adjusted so that it will generally exert an uplift upon the body of the user within a range of approximately twenty-five percent of the given body weight. And, the spring reaches a steady state condition somewhere upwardly off the ground, and usually above the hip heighth of the crossarm user, so as to maintain that continuous uplift upon the user as he stands in preparation for performance of a gymnastic maneuver. It has been found through usage of this invention, incorporating the foregoing type of cable retractable spring means, that a performer, particularly when utilizing this crossarm for gymnastic purposes, will be able to suspend himself in the air for approximately fifty percent more time than can be achieved under normal body unsupported conditions. Usually, the gymnast will have to pull down upon the bearinged support that surrounds his hips in order to fit into it when getting ready for performing gymnastic exercises.

The crossarm is designed preferrably having some downward angular disposition, so as to essentially place each lateral side of the crossarm at an approximate perpendicular with respect to the cable directed downwardly towards the bearinged support of the gymnast, and to assure the structural rigidity of said crossarm, bracings are provided along their upward surfaces to enhance their strength under tension. In addition, the crossarm is designed for being hingedly mounted to the bearings that support it upon tracks or rails for longitudinal movement, as previously described in our earlier application, with the hinging being formed through the use of an additional shaft that extends between flanges that extend upwardly from the topside of the crossarm, approximate its central location, with said shaft extending through the bearing carriage that holds the crossarm onto the tracks or rails upon which the entire structure rides.

DESCRIPTION OF THE PREFERRED EMBODIMENT

Figure 1:
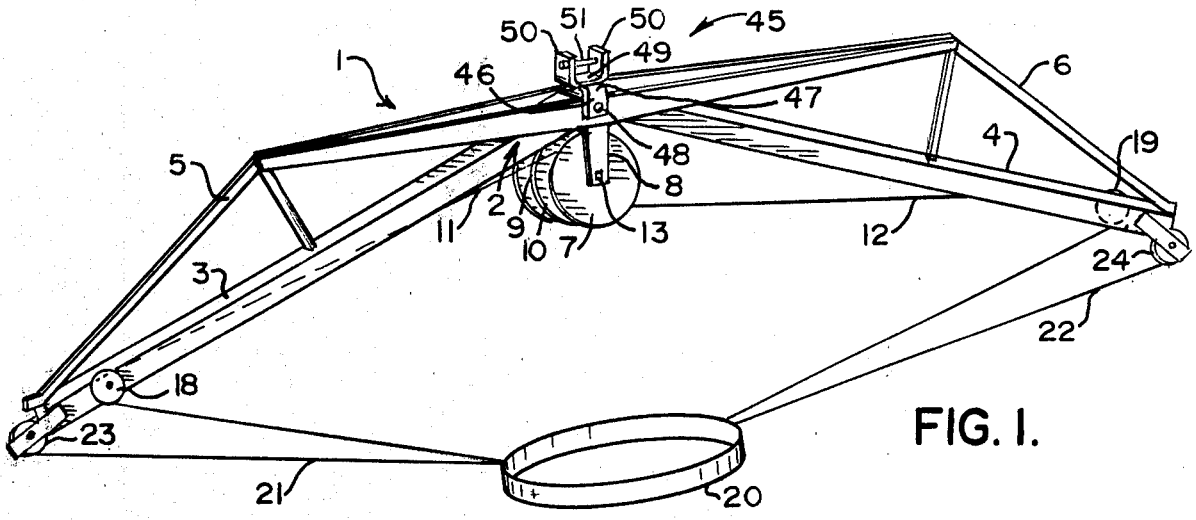
FIG. 1 provides an isometric view of the improved style of crossarm of this invention.

In referring to the drawings, and in particular FIG. 1, there is shown the crossarm 1 of this invention comprising a structural member 2 that extends laterally to either side, as at 3 and 4, and which sides are inclined slightly downwardly in order to orient its cables generally towards a focal point where the bearinged support (not shown), of the type generally described in my parent application, is suspended by means of the crossarm cables. In order to reinforce the lengthy laterally disposed members 3 and 4, bracings, as at 5 and 6, are provided and furnished arranged along the upward sides of the said crossarm, and therein structurally reinforced the crossarm to resist any buckling or collapsing as when it is exposed to the impacting forces that can be generated by the maneuvering gymnast.

Figure 2:
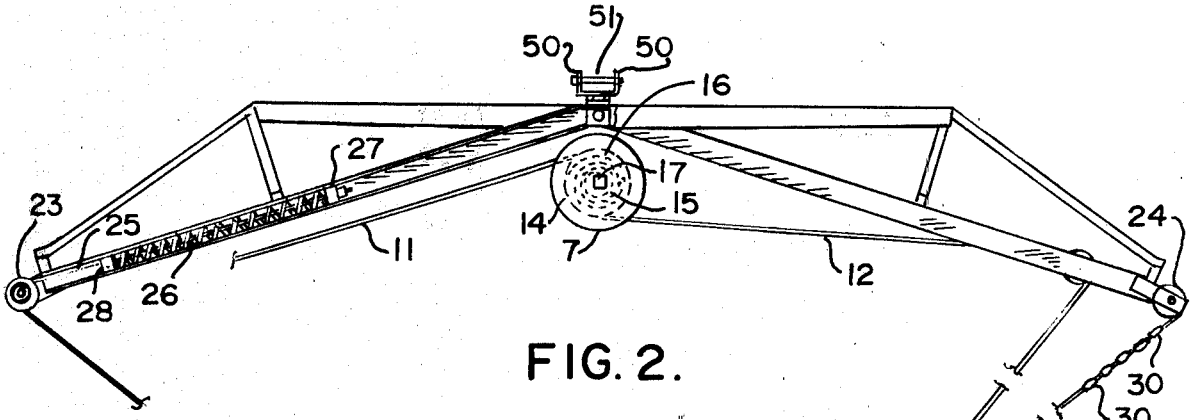
FIG. 2 furnishes a view from one side of the crossarm, with portions of its structural means being broken away to disclose the locating of the cable ends upon the various shown springs.
Figure 3:
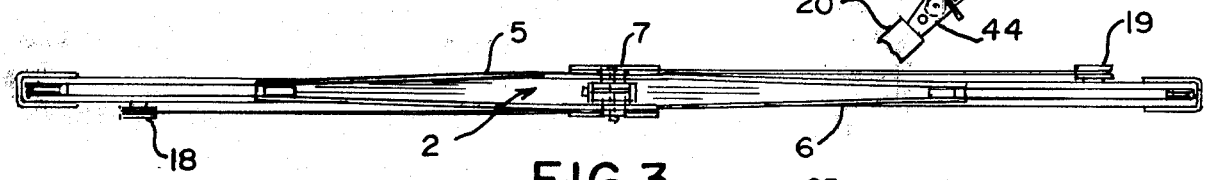
FIG. 3 provides a top view of the crossarm shown in FIG. 2.

As can be also seen in FIG. 2, a cable holding means 7 is provided centrally but downwardly from the central portion of the crossarm, being secured thereat by means of a pair of flanges, one being shown at 8, and this cable holding means is formed in the shape of a reel, being divided into two sections 9 and 10, and useful for holding the two shown separate cables 11 and 12, respectively, that are retracted onto or unwound from their shown divided reel halves. The cable holding means 7, or this reel, is mounted for rotation upon the fixed shaft 13, said shaft spanning the space between the pair of flanges 8, as previously identified. Provided within the spacing between the base 14 of the reel and the shaft 13, at a location between the sides of the cable holding means 7, is a spring means 15, with said spring being engagable at its outward end, as at 16, with the said base 14 of the reel, while its inward end 17 may be fixed onto the shaft 13, as previously identified. Thus, while cables are being unwound from the holding means 7, the spring, in this particular instance being a spiral or helical spring, as shown, tightens in its resiliency, thereby having an integral bias that tends to urge a retracking of the cables 11 and 12 back onto said cable holding means, and which does occur when weight is lessened upon the structure.

It should be noted from FIGS. 1 and 2 that the cable 11 leading towards the left side of the crossarm unwinds from the top of its reel portion 9, while the cable 12 extending towards the right side of the crossarm unwinds from the lower side of its reel portion 10. The reason for this is that both cables will unwind simultaneously as the cable holding means 7 turns in a counterclockwise direction, and in the alternative, as the bias of the spring 15 takes effect, and causes a retracting or rewinding of any slack in the cables 11 and 12, such occurs simply due to a clockwise rotation of the said cable holding means 7, principally due to the draw of the spiral spring 15.

Figure 5:
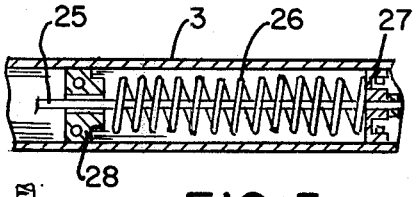
FIG. 5 shows an opposite end of a cable that extends into the tubular member of the crossarm as it affixes to the inwardmost disposed end of the shown coil spring.

As can be further seen, each of the cables 11 and 12 extend outwardly and pass around the sheaves 18 and 19, respectively, and then extend downwardly for sheaving around the bearinged support 20 that embraces the gymnast. Each of the cables then extend back upwardly, as at 21 and 22, and are sheaved once again as at 23 and 24, respectively, having their ends then extending further inwardly into the interior of the tubular members forming the structural members 3 and 4. Within the tubular members 3 and 4, as can be seen from FIGS. 2 and 5, with respect to the left side of the crossarm, the cable end 25 extends through a coil spring 26 and is fastened at its inwardmost end, as at 27, to said spring. This end of the spring is free to move within the crossarm, while the opposite end of the spring, or the end 28, is fixed in place. Thus, pressure upon the cable 21 and 25, with respect to the left side of the crossarm, will cause the spring 26 to undertake some compression, thereby adding additional resiliency to the cable at this location, and which tends to buffer any impact generated at the location of the bearinged support 20. Obviously a similar type of structural arrangement, including another coil spring, for holding the opposite end of the cable 22, is provided within the tubular member forming the lateral structural member 4 at the right side of the same crossarm 1.

Figure 4:
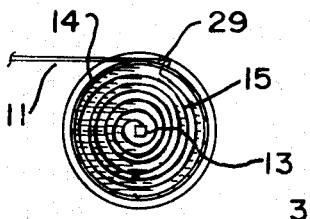
FIG. 4 discloses a sectional view of the cable retracting means, and further showing its spiral spring supported reel that rewinds or feeds out the supporting cables.

FIG. 4 discloses only one half of the cable holding means 7, showing how the cable 11 is hooked as at 29 to the base 14 of the said formed reel. In addition, the spring 15 is shown arranged within the interior of the base 14 of said reel, and being hooked at its inward end with the supporting shaft 13. And, it can herein be clearly seen that as the cable 11 is withdrawn, it has a tendency to tighten the spring 15, so that as once the force on the cable is reduced, the spring will have a tendency to retract the cable back onto the reel 7, and particularly such will occur when slack is generated upon the cable under conditions as previously described. The spiral spring of this invention is of the type that is currently available, and sold as the Negator spring by the Hunt Spring Company, which is a division of Ametek Corporation of Hatfield, Pennsylvania.

Figure 6:
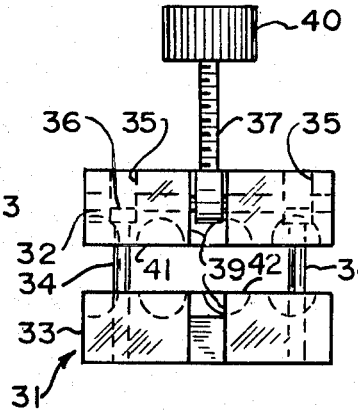
FIG. 6 discloses a locking mechanism for securing upon ferrules for functioning as the cable locking mechanism of this invention.
Figure 7:
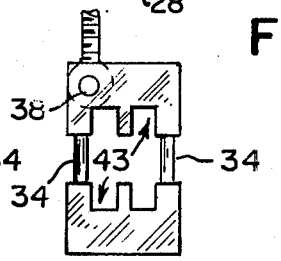
FIG. 7 shows a side view of the locking mechanism of FIG. 6.

Some additional features are provided in this invention and which enhance its operations. For example, as can be seen in FIG. 2, there are provided a series of ferrules or connectors, as at 30, and which can be swaged onto the cable at any particular location for the following reasons. These members may be formed of a more malleable metal, such as copper, and slid onto the cable, and can then be swaged in place. The function of these ferrules is to provide a limit to the extent of drawout of the cables 11 and 12 from the cable holding means, or to limit the extent or rewinding of the cables back onto the cable holding means. In referring also to FIGS. 6 and 7, a stop mechanism 31 is provided, and this stop is designed for fastening onto any selected one of the positioned ferrules 30, tightened in place, with this then functioning as a stop to prevent the cable from passing around either the sheave 24, or any sheave that is associated with the side of the support 20, and around which the cable 22 normally would pass. The stop includes upper and lower parts 32 and 33, respectively, with the lower part 33 having a series of pins 34 extending upwardly therefrom. These pins are disposed for extending through slots 35 provided through the upper member 32, so that the member 32 can slide closer to or away from the part 31, in order to provide clearance between the two members, as shown. Heads 36 are provided upon the pins 34 to prevent a full removal of the member 32 from the base 33. A fastening pin 37 is pivotally secured, as at 38, to the upper part 32, and can pivot downwardly a full 180°, from the position as shown in FIG. 6, for insertion through the provided slots 39, with the fastener or nut 40 being provided upon the threaded pin 37, capable of then being tightened for binding against the underside of the part 33, for firmly drawing these two parts 32 and 33 together, and binding them tightly against any ferrule 30 that may be positioned intermediate thereof. The inner surfaces 41 and 42 of each of these parts 32 and 33, respectively, are grooved or fluted, as can be seen in FIG. 7, as at 43, so as to provide a tight binding upon any ferrule 30 that may be located and fixed therein, as when the nut 40 is tightened upon its pin and urges the bottom part 33 tightly against said part 32. Thus, when the stop means 31 is located in place upon a ferrule 30, it can be seen that it will conveniently prevent the cable from retracting any further when said stop encounters the sheave 24, or to prevent any further unwinding of the same cable when the stop encounters any sheave associated with the side of the bearinged support 20. Such a sheave is illustrated in FIG. 2 at 44.

Another feature of this invention is the provision of means for providing some pivot to the entire crossarm during its usage. And, as can be seen in FIGS. 1 and 2, this pivot can be attained in two directions, through the use of the hinge mechanism 45 provided at the upper central portion of the crossarm 1. A pair of flanges, one is shown at 46, extend downwardly from their formed U bracket 47, and are mounted upon a pin 48 that extends through the structural member of the crossarm. Thus, pivot from side to side can be obtained through the functioning of this particular bracket. In addition, another U bracket, as at 49, extends upwardly from the first named bracket 47, and has its integral flanges 50 mounted with a pin 51, and this particular pin furnishes front to back pivot for the crossarm, through its pivotal mounting with the cradle mechanism (not shown), that supports a crossarm of this type, and which cradle mechanism was previously described and analyzed in detail in the parent application earlier identified. Thus, both side to side pivot, and front to back pivot, can be obtained for this crossarm when supporting the gymnast so as to add flexibility in its usage and a dampening of any of the abrupt forces that may be encountered during application of this device.

For the sake of convenience, this particular crossarm has been analyzed as predominantly being used in conjunction with gymnastic equipment. But, as can be understood, and particularly after reviewing our parent application herein, the type of crossarm shown herein, and its various accessory items, such as the hinge means 45, or the like, can be used for other purposes, such as for aiding the handicapped or for related type purposes.

Variations in the construction or modification of the components of this particular styled crossarm, and its various accessory items, may be considered by those skilled in the art upon reviewing the subject matter of this invention. Such variations or modifications, if within the spirit of this invention, are contemplated to be protected by the scope of any claims to patent protection issuring upon this invention. The description of the preferred embodiment set forth herein is provided for illustrative purposes only and is not meant to be limitation of the invention as analyzed.

Having thus described the invention what is claimed and desired to be secured by Letters Patent is:

1. A crossarm for use in conjunction with gymnastic equipment or the like and for suspending a support for holding a gymnast, said crossarm being arranged for depending from upwardly disposed structure, said crossarm including a length of structural member extending above and laterally to either side of any supported gymnast, said crossarm structural member comprising a tubular member, a pair of cables, one of each cable operatively associated with each laterally extending tubular member of the crossarm and being connected thereto, each cable extending downwardly for sheaving upon the gymnast's support, a pair of sheaves operatively associated with the proximate ends of the tubular member of the crossarm, each cable further extending around each pair of sheaves operatively associated with each end of the tubular support, each of the cables extending upwardly from the support and being arranged around each of said sheaves and further extending into and partially through the said tubular member, the ends of said cables extending into the tubular member being resiliently fixed with respect to said tubular member, cable holding means, said cable holding means being secured proximately centrally of the tubular member of the crossarm, said cable holding means being divided for winding and holding each cable separately, said cable holding means comprising a sectionalized reel, one of each cables being wound upon separate reel sections, spiral spring means being located within the cable holding means, said spring at one end being fixed to the cable holding means and its sectionalized reel, said spring at its other end being fixed with respect to the structural member of the crossarm, and said spring means causing a bias tending to effect a retracting of the cables forcefully unwound by the weight of the gymnast and the suspended support during crossarm usage.

2. The invention of claim 1 and including a pair of spring members, one of each spring member being disposed within each laterally extending portion of the tubular member forming the crossarm, and the said cables extending into said tubular members being fixed with the inwardmost end of the associated spring member, the outwardmost end of each spring member being fixed within the tubular member of the crossarm, whereby upon a pulling of the said cables the spring means providing for variation under pressure in the length of the cable with respect to the held support.

* * * * *